US007380795B2

(12) United States Patent
Novellie et al.

(10) Patent No.: US 7,380,795 B2
(45) Date of Patent: Jun. 3, 2008

(54) METHODS AND APPARATUS FOR PLAYING POKER GAMES

(75) Inventors: Michael Paul Novellie, Isle of Man (GB); Theo Naicker, Durban (ZA); Wesley John Harding, Westville (ZA)

(73) Assignee: Waterleaf Limited, Douglas (IM)

( * ) Notice: Subject to any disclaimer, the term of this patent is extended or adjusted under 35 U.S.C. 154(b) by 220 days.

(21) Appl. No.: 11/180,501

(22) Filed: Jul. 12, 2005

(65) Prior Publication Data

US 2007/0013133 A1 Jan. 18, 2007

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12
See application file for complete search history.

(56) References Cited

U.S. PATENT DOCUMENTS

| | | | | |
|---|---|---|---|---|
| 5,486,005 | A | 1/1996 | Neal | 273/292 |
| 5,639,092 | A | 6/1997 | Macaisa | 273/292 |
| 5,685,774 | A | 11/1997 | Webb | 463/13 |
| 5,823,873 | A | 10/1998 | Moody | 463/13 |
| 5,868,392 | A * | 2/1999 | Kraft | 273/292 |
| 6,007,066 | A | 12/1999 | Moody | 273/292 |
| 6,206,373 | B1 * | 3/2001 | Garrod | 273/292 |
| 6,435,510 | B2 * | 8/2002 | Moore | 273/292 |
| 6,698,759 | B2 | 3/2004 | Webb et al. | 273/292 |
| 6,752,395 | B2 | 6/2004 | Jones et al. | 273/292 |
| 2005/0242506 | A1 | 11/2005 | Yoseloff | 273/292 |
| 2005/0269775 | A1 * | 12/2005 | Sorge | 273/274 |

* cited by examiner

*Primary Examiner*—Benjamin H Layno
(74) *Attorney, Agent, or Firm*—McDonnell Boehnen Hulbert & Berghoff LLP

(57) ABSTRACT

Methods and apparatus for playing poker are provided. The method includes a step of placing an ante bet for each of one or more hands to be played. The player may optionally place a side bet for each of the one or more played hands. The side bet is that a set of cards (e.g., two) to be dealt to such hand will have a predetermined ranking. In any event, the set of cards are dealt to each played hand. For each of the played hands, the player takes one of the following actions: a fold action, a call action, or a raise action. Then, one or more community cards are dealt (alternatively, the cards are dealt into each hand directly). Then, a ranking is done each of the played hands, each played hand formed of the initial set of cards dealt plus the community card(s). A payout occurs for each of the played hands according to the wager, the ranking, the result of any side bets placed, and a predetermined paytable.

29 Claims, 11 Drawing Sheets

METHODS AND APPARATUS FOR PLAYING POKER GAMES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to poker games and more particularly to a novel poker game and variants thereof suitable for casino, video poker and online gaming environments.

A variety of poker games are known in the art, including well known five and seven card stud poker games, variations on Hold'em games, and still others. The patent literature includes a number of different poker games, including those disclosed Webb, U.S. Pat. Nos. 6,698,759 and 5,685,774. Moody's U.S. Pat. Nos. 5,823,873 and 6,007,066 describe a multi-play poker game wherein a player may play more than one hand during a turn of a game.

Proprietors of gaming establishments, including online gaming casinos operators, continue to have a need for new games that are attractive to players, in that players that play the same game repeatedly may become bored with the game and lose interest. The present game and variants thereof disclosed herein provide new poker games that are easy to learn and play, provide for a high level of interest, and provide the player with the opportunity for playing multiple hands simultaneously. However, the details on the play of the game are quite different from either the Moody or Webb patents cited above.

SUMMARY

The following embodiments and aspects thereof are described and illustrated in conjunction with systems, tools and methods which are meant to be representative, not limiting in scope. In various embodiments one or more of the above-described problems have been reduced or eliminated, while other embodiments are directed to other improvements.

In a first aspect, a method is provided for playing a poker game. The method includes a step of placing an ante bet for each of one or more hands to be played. The player may optionally place a side bet for each of the one or more hands to be played, the bet being that a first set of cards (e.g., two cards) to be dealt to such hand will constitute cards having a predetermined ranking (e.g., two cards of the same suit). Two cards are dealt to each played hand (preferably face up). For each hand in which the side bet is played, the two cards are ranked. For each of the played hands, the player takes one of the following actions: a fold action, a call action or a raise action. Then, one or more community cards, such as three or five such cards, are dealt. Then, a ranking is done of each of the played hands for which a call action or a raise action has been taken, each played hand formed of the two respective dealt cards in that hand plus the community card(s). The method continues with paying out each of the played hands according to the ranking, the result of any side bets placed, and a predetermined paytable.

In a second aspect, a method is provided of playing a poker game. The method includes a step of (a) providing a display of a play area for a plurality of hands. The play area comprises a wagering area for each hand to be played. The wagering area further comprises a first location for placing an ante bet, a second area for placing a raise or call bet, and a third area for placing a side bet. The play area further comprises a community card area where community cards are dealt. The method continues with the steps of (b) receiving a selection of hands to be played; (c) receiving an ante bet for each hand to be played; and (d) dealing two cards for each played hand. The method continues with steps (e) receiving a selection of a fold, call or raise action for each of the played hands and then (f) dealing one or more community cards in the community card area. The method continues with step (g) ranking each hand for which a call or raise action was taken in step (e), each hand comprising the two dealt cards plus the community cards, and step (h) paying out each hand in accordance with a predetermined paytable, the amount wagered and the ranking in step (g).

In this second aspect, the method may also include the optional steps of (i) receiving a side bet in advance of the dealing of the two cards to each played hand and (j) for each hand in which a side bet is placed, ranking the two cards and paying out each hand for which a side wager is placed in accordance with the ranking, the amount wagered in the side bet and a second side wager paytable.

In a third aspect, the invention may take the form of a set of computer instructions stored on machine readable storage medium providing user interface features facilitating playing a poker game using an electronic gaming device such as a video poker terminal, general purpose computer, or portable computing device. The instructions include instructions (a) providing a display of a play area for a plurality of hands and wherein the play area comprises a wagering area for each hand to be played, the wagering area further comprising a first location for placing an ante bet, a second area for placing a raise or call bet, and a third area for placing a side bet; the play area further comprising a community card area where community cards are dealt. The instructions also provide for (b) receiving an election of hands to be played, e.g., by activation of an icon such as by clicking on an ante icon in the play area. The instructions further include instructions (c) receiving an ante bet for each hand to be played and (d) providing a deal icon which, when activated, causes two cards to be dealt for each played hand. The instructions still further include instructions (e) providing icons by which a player may make a selection of a fold, call or raise action for each of the played hands. The instructions further provide instructions for (f) dealing one or more community cards in the community card area. Finally, the instructions perform a step (g) of ranking of each hand for which a call or raise action was taken in step (e), each hand comprising the two dealt cards plus the community cards; and (h) paying out each hand in accordance with a predetermined paytable, the amount wagered, and the ranking in step (g).

Further variants of the game are disclosed in which there are no "community cards" and additional cards are dealt directly into each of the playing hands.

In addition to the representative aspects and embodiments described above, further aspects and embodiments will become apparent by reference to the drawings and by study of the following detailed descriptions.

BRIEF DESCRIPTION OF THE DRAWINGS

Representative embodiments are illustrated in referenced figures of the drawings. It is intended that the embodiments and figures disclosed herein are to be considered illustrative rather than restrictive.

DETAILED DESCRIPTION OF REPRESENTATIVE EMBODIMENTS

The poker games of this disclosure are suitable to a variety of game environments, including a casino or pool room environment in which the game is played with physical cards, as well as electronic formats including video poker machines and playing games on other electronic game devices such as a general purpose computer. The play of the game is essentially the same regardless of the format or environment. While the following description will be in the context of an electronic gaming format, it will be appreciated that the principles of the game are applicable to other environments.

Methods of Play

Figure 1:
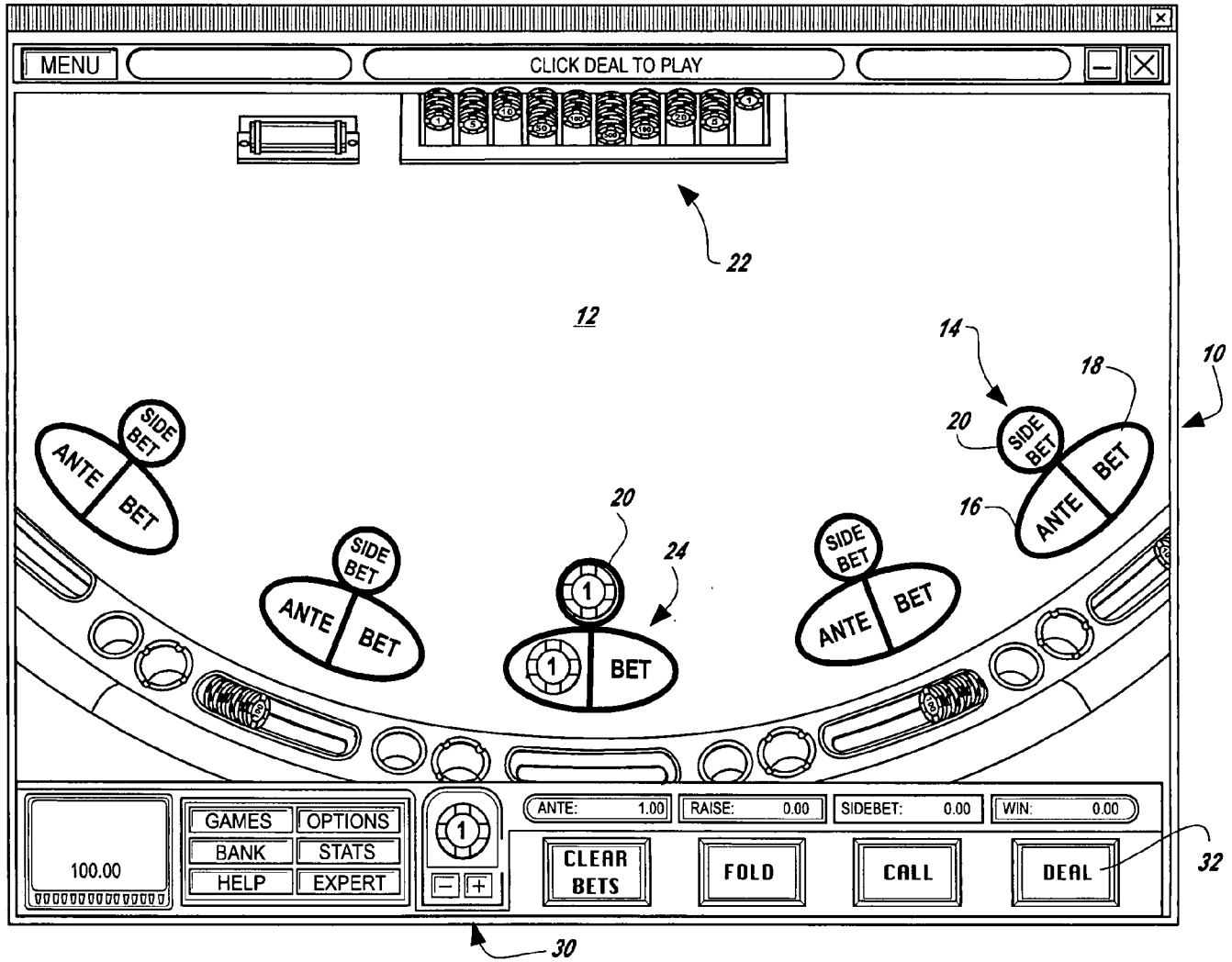
FIG. 1 is a display presented on a general-purpose computer showing a layout for playing the preferred embodiment of a poker game in accordance with the present disclosure.

FIG. 1 shows a display 10 presented on a general-purpose computer showing a layout for playing the preferred embodiment of a poker game in accordance with the present disclosure. The display 10 includes a display of a play area 12 for a plurality of hands. The play area may take the form of a table or virtual table. The game can be played with any number of hands simultaneous, such as one, two, five (as shown) or ten hands. The play area 12 includes a wagering area 14 for each hand. The wagering area 14 includes a first location 16 for placing an ante bet, a second location or area 18 for placing a raise or call bet, and a third area 20 for placing a side bet. The play area 12 includes a community card area 22 where community cards are dealt later on during play.

Figure 2:
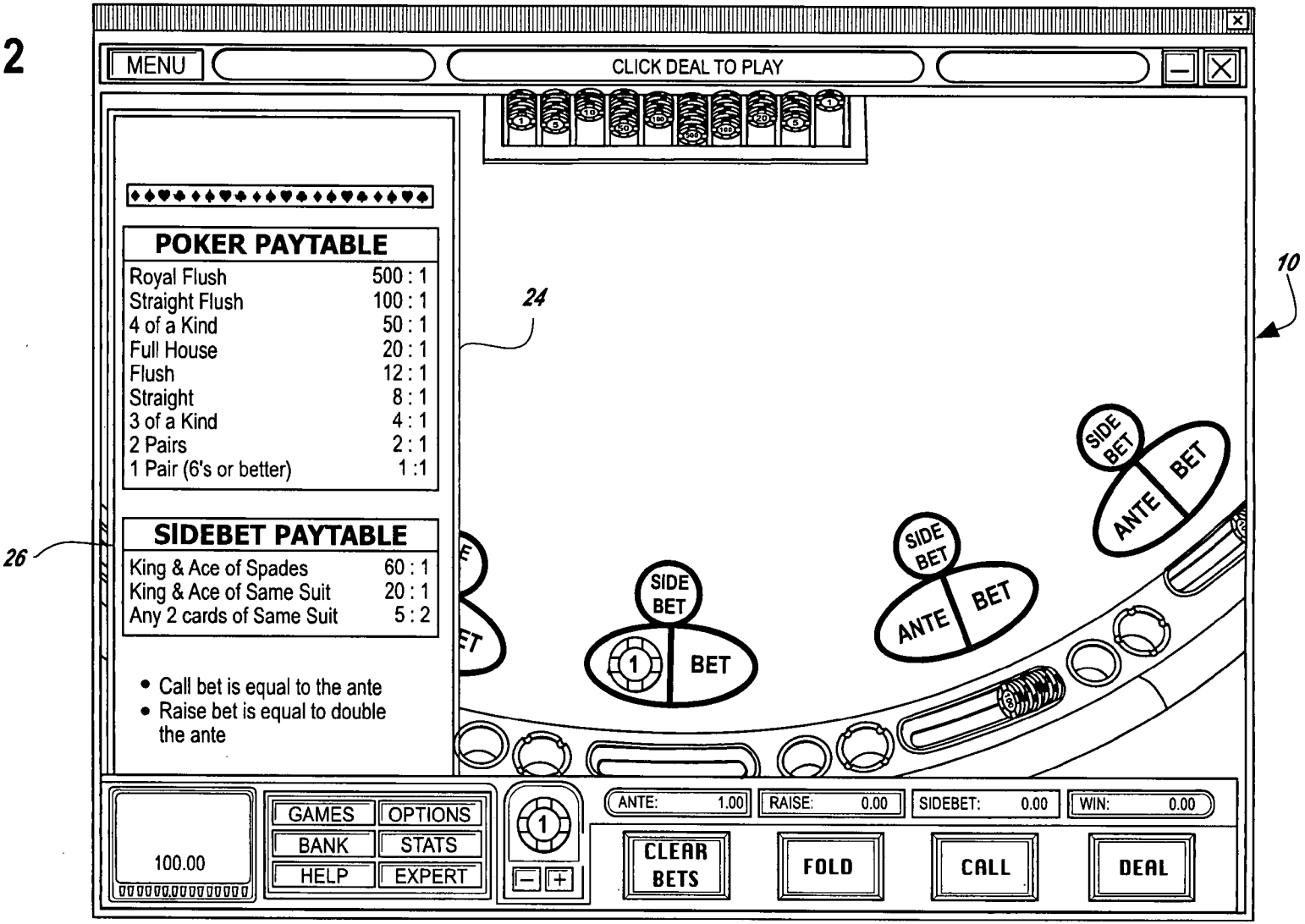
FIG. 2 shows the display of FIG. 1, with a paytable superimposed over a portion of the screen display which pops up when the player places their cursor over the left hand side of the display.

As will be discussed below, the game is played with reference to a paytable. The table is revealed to the players when they move their cursor over to the left hand side of the display. FIG. 2 shows the screen shot of FIG. 1, with a paytable 24 superimposed over a portion of the screen display. The particular paytable to construct may depend on such factors as the presence of wild cards, the number of community cards, the number of cards dealt initially, and other factors. In the illustrated embodiment, there are two paytables. A first or primary paytable 24 is provided for the case where two cards are initially dealt to each playing hand and there are three community cards, the combination of which forms a five card poker hand. An example of a paytable 24 pays out according to the following schedule:

Royal Flush 500:1
Straight Flush 100:1
Four of a kind 50:1
Full House 20:1
Flush 12:1
Straight 8:1
3 of a kind: 3:1
2 pairs: 2:1
one pair (6's or better) 1:1

The second paytable 26 is a paytable for a side bet that the player has an option of making. The side bet is that the first two cards dealt to the player will have a predetermined ranking. The second paytable 26 may also vary, depending on the number of cards dealt initially and the characteristics of the game the proprietor chooses to offer. In the illustrated embodiment, the second paytable pays out 60:1 for two dealt cards that are the Ace and King of Spades, 20:1 for the Ace and King of any other suit, and 5:2 for two cards of the same suit. (As an example variant of the game, the second paytable could also pay out if the player drew a pair of the same rank, such as a pair of Jacks.) The paytables 24 and 26 pop when the cursor is placed near the left hand edge of the display and disappear when the cursor is moved away from the edge. This feature prevents the paytables from obscuring the hands on the left hand side of the display of FIG. 1 during play.

Figure 3:
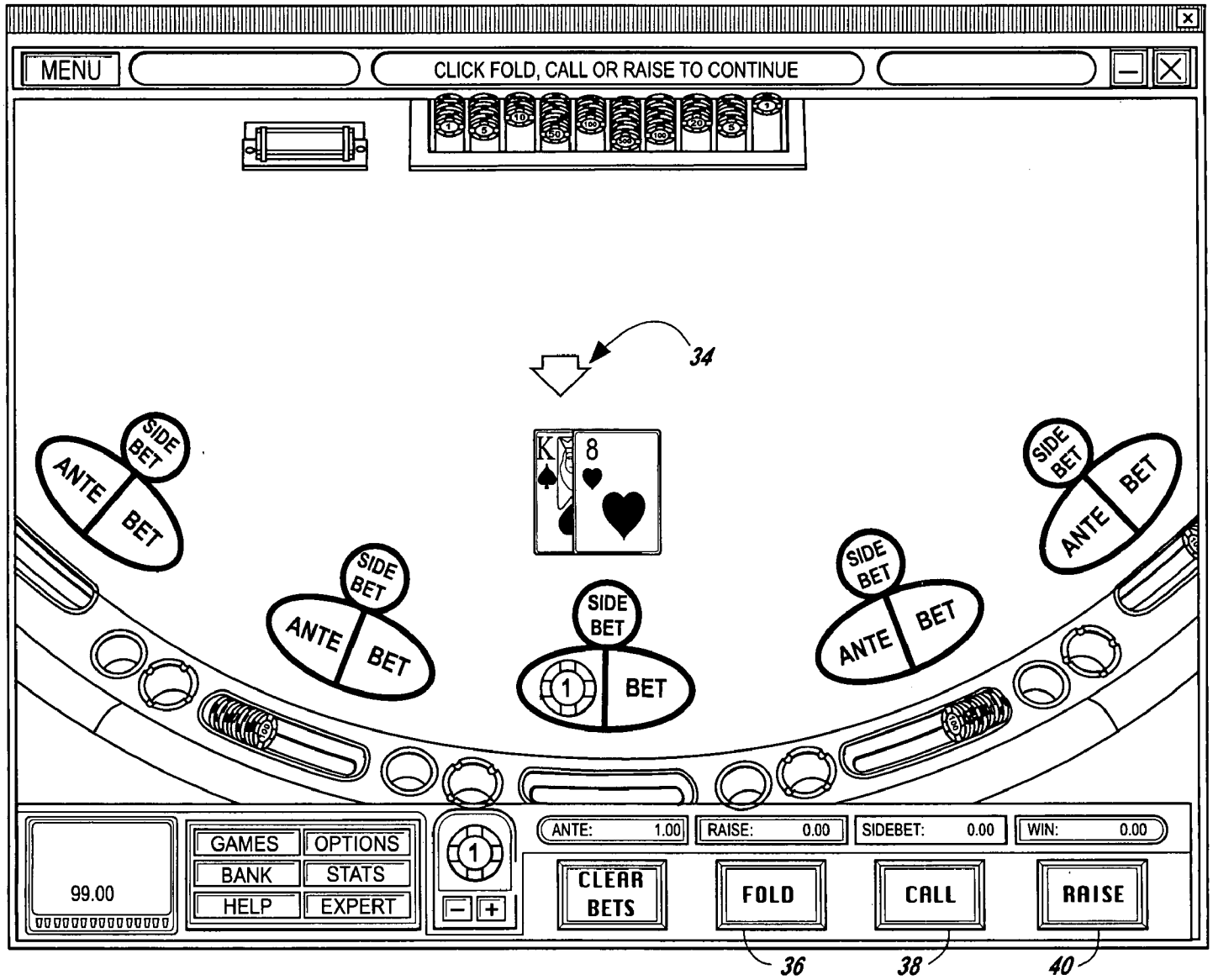
FIG. 3 shows a display which appears after a player has elected to play a single hand without a side bet, and proceeded to click on the "Deal" icon of FIG. 1.
Figure 4:
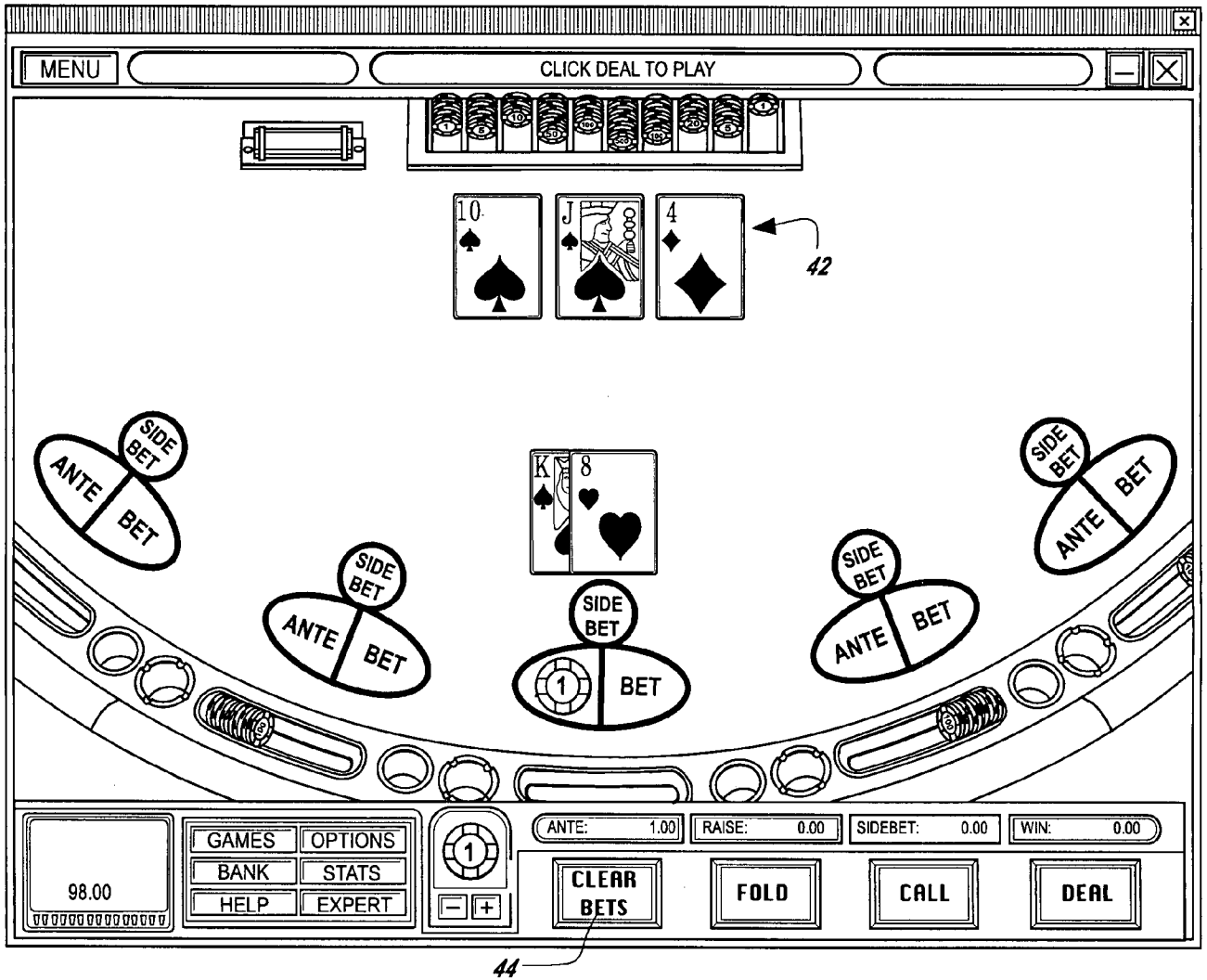
FIG. 4 shows a display in the game of FIG. 3 after wagering of the hand is complete and the three community cards are dealt.

Referring now to the flow chart of FIG. 10 in combination with FIGS. 1, 3 and 4, at step 102 the player launches the poker application (or logs into an on-line casino) and the display of the play area of FIG. 1 is presented.

At step 104, the player places an ante bet for a selected hand to play. In the example of FIG. 1, the player has elected to bet "1" unit or token on the bottom center hand 24 or play position. By using the "+" or "–" icons 30 at the bottom of the display they can adjust the size of the ante bet.

At step 106 the player may place an optional side bet that the first two hands dealt will be of a predetermined rank as indicated in the paytable 26 of FIG. 2. To place the side bet, they click on the "side bet" icon 20 in the play position 24. They can use the icons 30 to adjust the amount of the side bet. Alternatively, they may click the icon 20 a second time to increase the amount of the bet from say one token to two tokens.

At step 108, the player may elect to play additional hands. To do so, they may move the cursor to any of the other player positions shown in FIG. 1 and repeat steps 104 and 106 (placing of an ante bet and any optional side bets).

For this initial example, for sake of simplicity, we explain one turn of the game with only one hand played and with no side bet placed. To deal the cards, the player clicks on the "Deal" icon 32, step 110 in FIG. 10. This causes two cards to be dealt to the player, step 112, which are shown in FIG. 3. The player has been dealt the King of Spades and the Eight of Hearts. A yellow arrow 34 is positioned over the hand to draw the player's attention to the hand currently being played. (As indicated at step 114, if a side bet had been wagered, at this point these two cards would have been ranked and the ranking compared with the side bet paytable 26 to see if the player won the side bet.)

At the state of the game shown in FIG. 3, the player has to decide whether to fold, call (place another bet equal to the ante) or raise their bet. In one version of the game, the raise bet is equal to double the ante. In other variations, the raise could be some other arbitrary integer number of units. The player makes a selection of fold, call or raise by clicking on the associated "fold", "call" or "raise" icons 36, 38, 40 respectively. Assume in this example that the player elected to call, resulting in a wager of another unit on the hand.

At this point, the screen shows three community cards 42 dealt for the hand (as shown in FIG. 4 and indicated at step 118). The cards 42 are considered "community cards" in that when the game is played with multiple hands at the table, each position uses the two cards dealt to it plus the three community cards to form a five card poker hand. It would be possible to have the three community cards dealt in other areas, such as adjacent to the first two initial cards, without departure from the scope of this disclosure. A further example of this variant is discussed in detail later.

At step 120, a ranking of each played hand occurs. As noted above, the single played hand consists of the two initial dealt cards (King of Spades and Eight of Hearts) plus the three community cards. In the example of FIG. 4, we do not have a winning hand in accordance with the paytable 24 of FIG. 2.

At the payout step (122), there is a payout (or decrement) to the player's account in accordance with the poker hand ranking, the wager, the side bet (if any) and the paytables 24 and 26. Since in the present example the player wagered one token for the ante and one token for a call, but did not win, their account is debited 2 tokens or units.

Figure 10A:
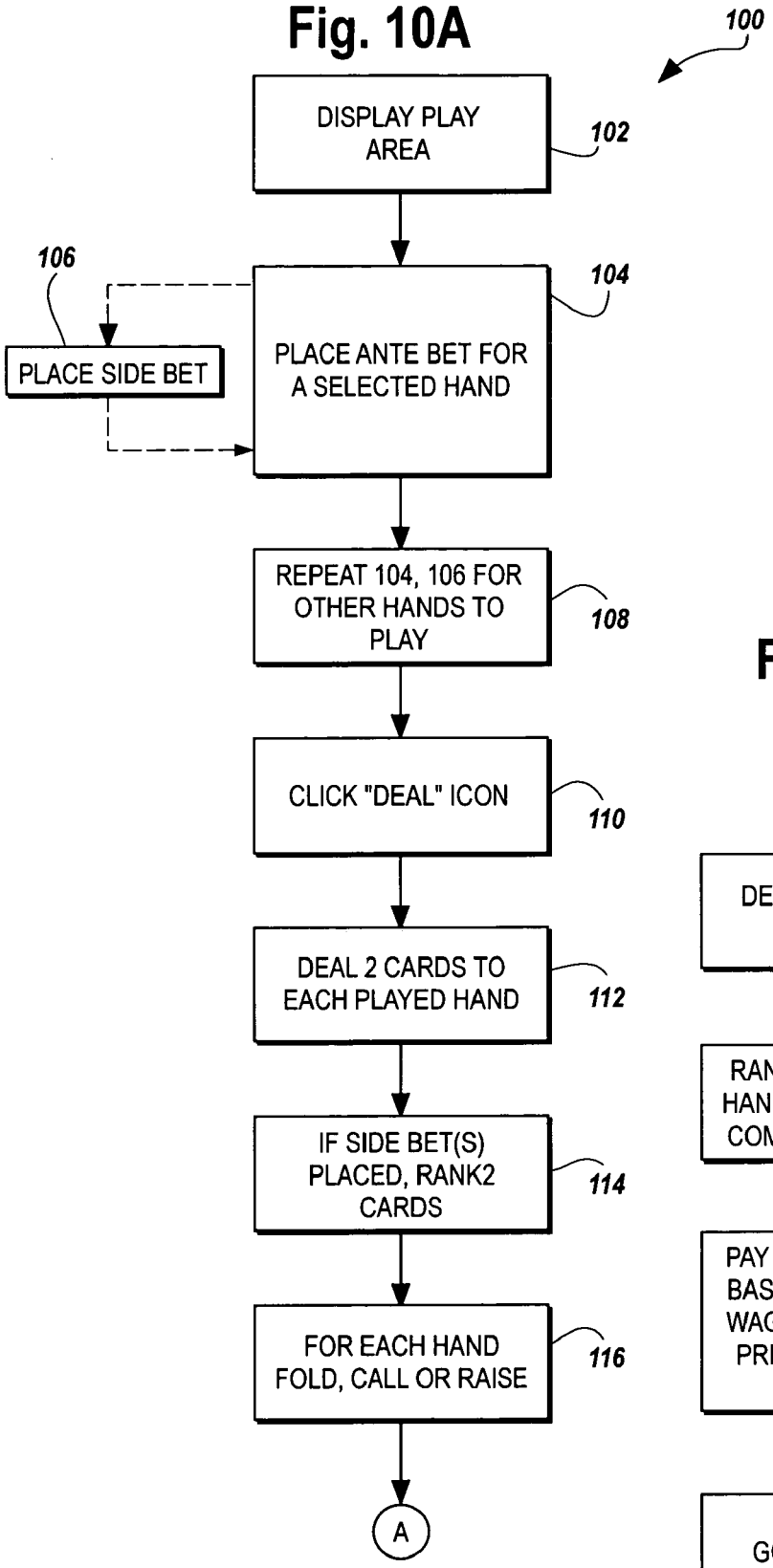
FIG. 10 is a flow chart showing the operation of the play of the game of FIGS. 1-9.
Figure 10B:
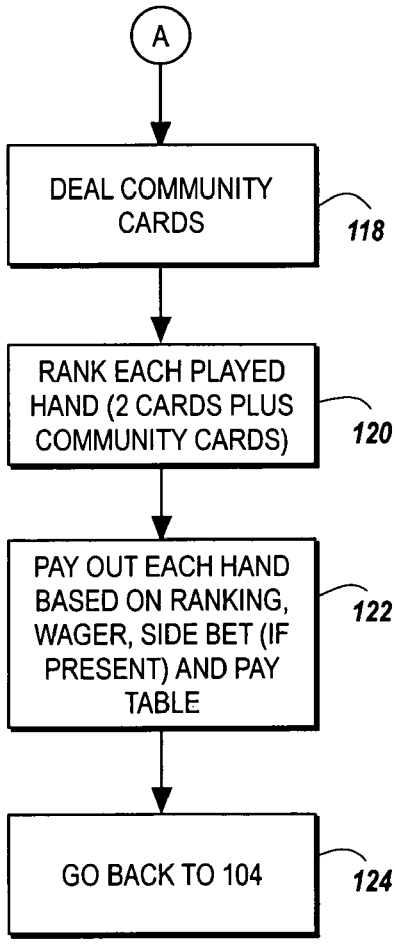

At step 124, the player may elect to play another round of the game by clicking on the "Clear Bets" icon 44 and the processing returns to FIG. 10A, step 104.

Referring again to FIG. 1, suppose the player wishes to play a new round of the game with three hands instead of one. They click on the "Ante" icon 16 on three separate hands to indicate an ante of one unit. Suppose they do this for three hands on the right hand side of the display. Suppose further that they decide to bet two units on the side bet for two of the hands and a side bet of one unit for another of the hands. They then click on the "Deal" icon and the screen display of FIG. 5 appears. Two cards are dealt to each play position. The cards at each position are also ranked, since the side bet was placed for each hand. The hand at position 46 placed a side bet of one unit and has a winning hand for the side bet (two cards in the same suit, the Six and Eight of Diamonds) and therefore wins a 5:2 wager per the paytable 26 of FIG. 2. The hands dealt at positions 48 and 50 did not win the side bet since the two cards at these positions do not have the required rank per the paytable 26 in order to pay out.

Figure 5:
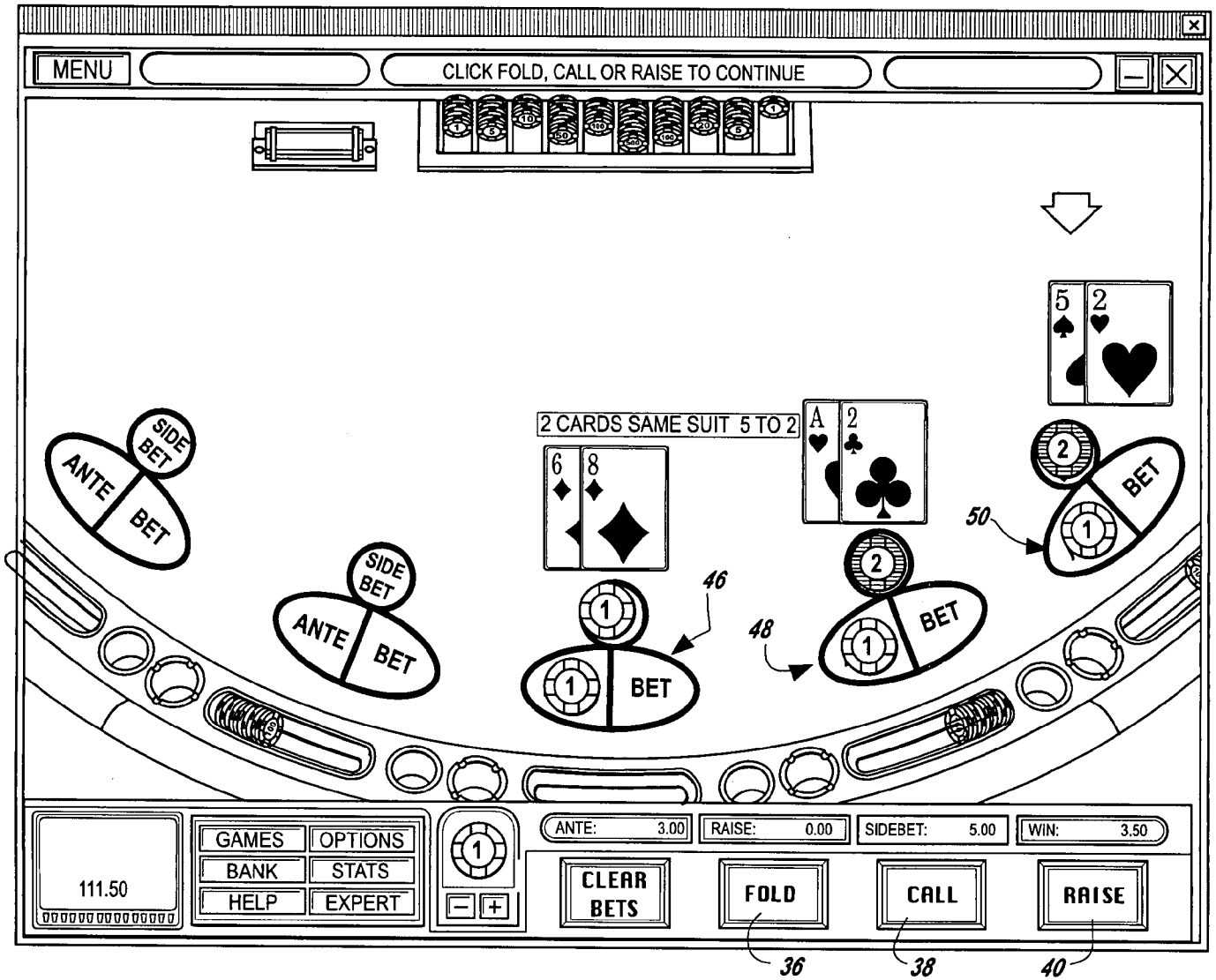
FIG. 5 shows a display of a new game where the player elects to play three separate hands, and has placed a side wager for each of the three hands, and then has clicked on the "Deal" icon to cause the first two cards to be dealt to each of the three hands.
Figure 6:
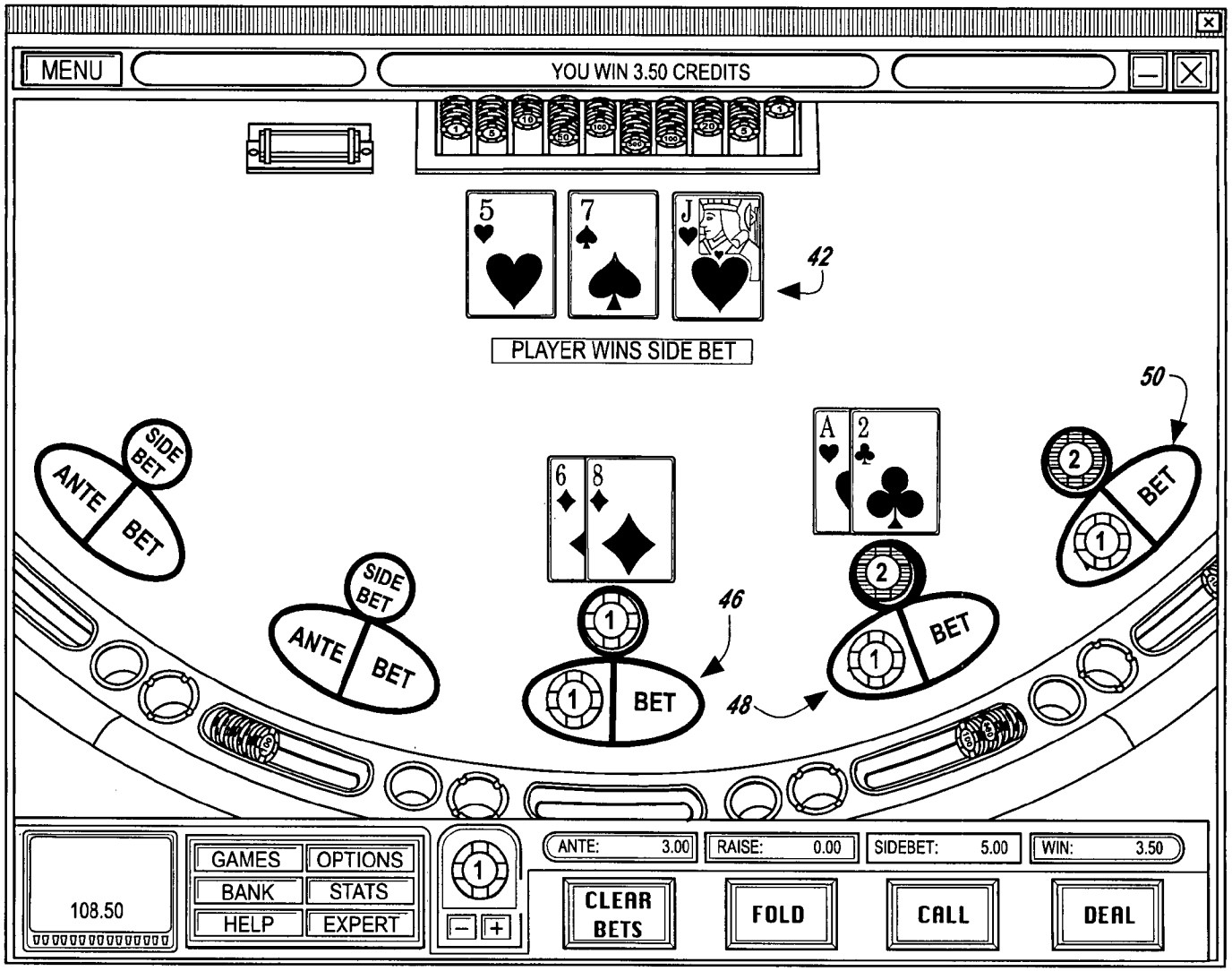
FIG. 6 shows a display of the game of FIG. 5 after the player has made a decision to raise, call or fold each of the three hands and the three community cards are dealt at the top of the screen. The resulting poker hands formed from the two dealt cards and the community cards are ranked and a payout occurs in accordance with the amounts wagered in each hand, the rankings and the paytable of FIG. 2.

As shown in FIG. 5, the arrow is pointing to the cards or hand at play position 50, and the player must decide to fold, call or raise the hand by clicking on the appropriate icon 36, 38 or 40. When they are done, the arrow moves over to position or hand 48 and they must do the same. Then, the arrow moves over to position or hand 46 and they must do the same. Assume in this example that player with hand 50 folds, player at position 48 calls, and player at position 46 raises. When the raise icon 40 is activated for the hand at position 46, the wagering is complete for all three hands and the three community cards 42 are automatically dealt. The resulting display is shown in FIG. 6. The hand at position 50 folded so these cards are removed from the screen. The cards for hand 48 are ranked. The cards for hand 46 are also ranked. With the three community cards dealt (Five of Hearts, Seven of Spades and Jack of Hearts), neither of hands 46 or 48 are winning hands. At step 122 (FIG. 10B), there is a payout (decrement, actually) according to the ranking, the wagers, the side bet and the paytables 24 and 26 of FIG. 2. Since the hand at position 46 won the side wager, the player won 2.5 units on the side wager but lost three units (one for the ante and two for the bet, a raise) on the hand formed by the community cards and their dealt cards (Six and Eight of Diamonds). The hand at position 48 lost two units on the side wager and two units on the hand (one for the ante and one for the bet). The hand at position 50 lost three units (one for the ante and two units for the side bet). In the present example, all three hands were played by one player so their account is debited by an amount equal to the sum of the payouts (or debits) for each hand played, a net total of –7.5 units (+2.5–3–2–2–3).

Figure 7:
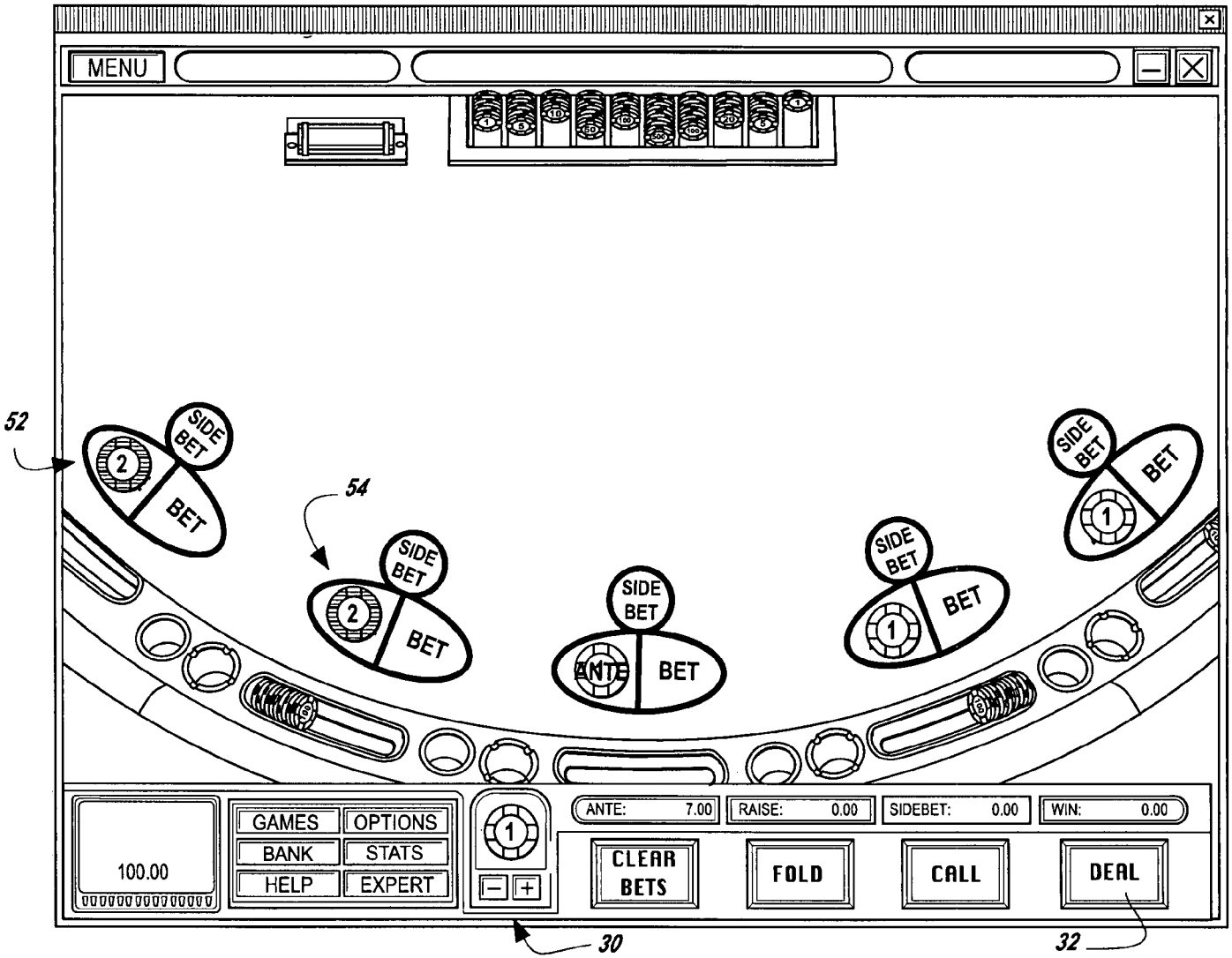
FIG. 7 shows a display of a new game where the player has elected to play five hands with no side bet. The player clicks "Deal" to have the initial set of cards dealt to each of the five hands.
Figure 8:
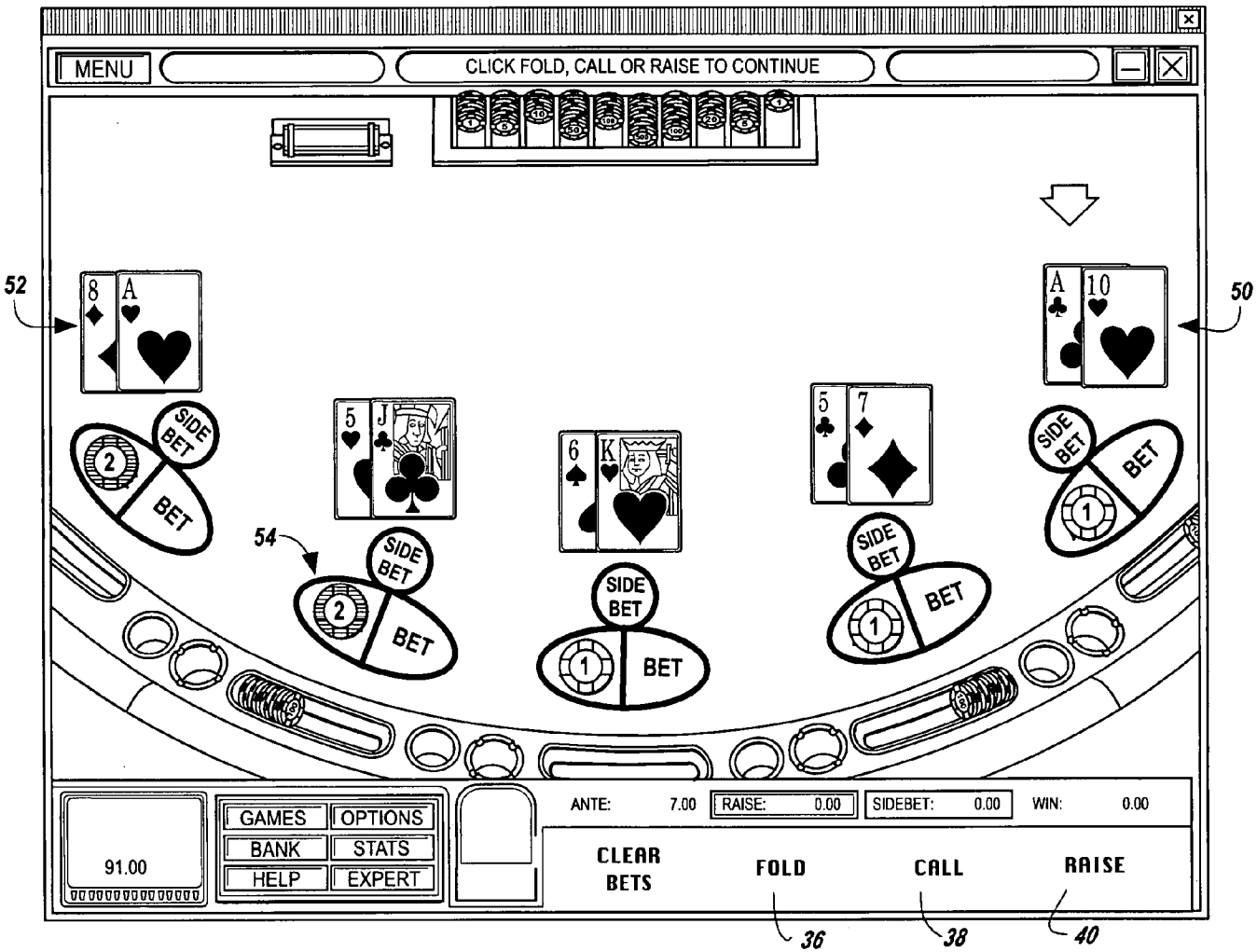
FIG. 8 shows a display of the resulting sets of two cards dealt to each of the five hands in the game of FIG. 7; the player then proceeds to fold, call or raise each of the five hands in turn.
Figure 9:
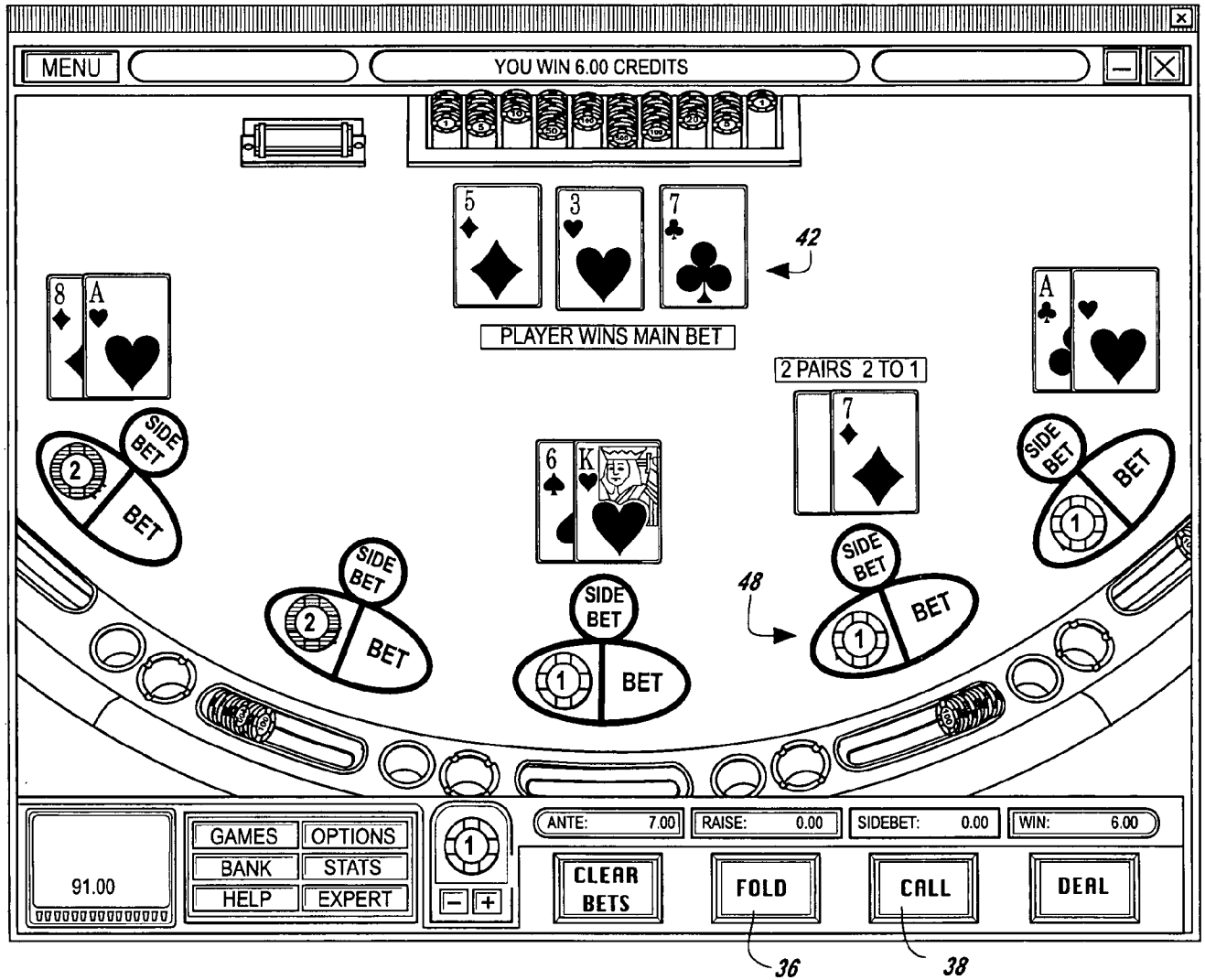
FIG. 9 shows the resulting screen shot of the game of FIGS. 7 and 8 after the player has made a decision on each of the five hands, whereupon the three community cards are displayed and the ranking of the hands is displayed.

FIGS. 7-9 show another example of the play of the game. In FIG. 7, the player has placed ante bets for each of the five play positions shown in the display 10. The two left-most hands 52 and 54 have an ante of two units, the remainder have antes of one unit. The antes are placed by clicking on the "Ante" icon shown in FIG. 1 and adjusting the amount by either clicking again on the ante icon or by using the "+" or "–" icon 30.

As the player is placing the ante wagers, the player may make any side bets by clicking on the "Side Bet" icon. In the present example, no side bets are placed.

When the initial ante betting is completed, the player clicks on the "deal" icon 32, whereupon a first set (two) cards are dealt into each hand. See FIG. 8. The arrow is over hand 50 and the player must decide whether to fold, call or raise by activating the appropriate icon 36, 38 or 40. When the wagering for hand 50 is done the arrow moves clockwise to the next position and the wagering repeats for the next hand, until all hands have been wagered. Assume in this example that each hand elected to raise, except for hand 54 which folded. When the wagering for hand 52 is completed, the screen reverts to that shown in FIG. 9. Three community cards are dealt. Each hand is then ranked, the hand formed of the two dealt cards plus the three community cards. The hand at position 48 is a winning hand consisting of a pair of fives and a pair of sevens. The remaining hands are losing hands.

Simultaneous with or after the ranking, a payout occurs, as explained above. For hand 48, three units were wagered (the one unit ante and the two unit raise), and the paytable indicates that two pairs pays out at 2:1 odds, so that hand won six units. Twelve units were wagered and lost on the other four hands for a net deduction of 6 units in the player's account.

While the display of FIG. 9 does not show the amount wagered in the "bet" field (2 units except for the hand that folded), the game software could be modified to show the amount bet in addition to the ante.

As a variant of the game, the initial dealing of cards could consist of more than two cards, such as three cards. As another variant, the community cards could consist of one or more cards. For example, if three cards were dealt initially, two cards could be dealt as community cards. As another example, three cards could be dealt initially and four cards could be dealt as community cards in a seven card stud embodiment. As another example, two cards could be dealt initially and five community cards could be dealt, in another seven card stud variation. The game software would select the best five of the seven available cards for each play position or hand and then rank that hand. Obviously, in these other variations, the paytable may change.

An example of a seven card stud paytable is as follows:

| | |
|---|---|
| Royal Flush | 50:1 |
| Straight Flush | 20:1 |
| Four of a Kind | 7:1 |
| Full House | 5:1 |
| Straight | 3:1 |
| Three of a Kind | 2:1 |
| Two Pairs, 10s or better: | 1:1 |

As another variant, after the initial two hands are dealt and the player places the wager (call or raise), instead of displaying all the community cards at once, a first community card is displayed and the player has the option of placing a further wager (call or raise) or folding. Then, the second card is displayed and the player may make a further wager or fold. Then, the third card is displayed. Obviously, this can be extended for a game in which more than three community cards are played. As still another variation where there are five community cards, two community cards are dealt, a wager or a fold occurs, then two additional community cards are dealt, another wager or a fold occurs, and then the final community card is dealt.

As another variation, the play area for multiple hands as shown in FIGS. 1-9 could have positions or areas for a different number of hands such as any number of hands between two and ten or more hands, wherein the player may elect to play up to ten hands. Alternatively, the play area may be designed to play just one hand.

As noted earlier, in the illustrated embodiment the wagering icons ("Call" and "Raise") are set up such that the call bet is equal to the ante and the raise bet is equal to double the ante bet. Other raise bets could be programmed into the game or the raise bet could be arbitrarily determined by activation of the "+" or "–" icons 30.

From the forgoing, it will be appreciated that a method of playing a poker game has been described including the step of (a) providing a display 10 of a play area 12 (FIG. 1) for a plurality of hands. The play area comprises a wagering area 14 for each hand to be played. The wagering area further comprises a first location 16 for placing an ante bet, a second area 18 for placing a raise or call bet, and a third area 20 for placing an optional side bet. The play area further comprises a community card area 22 where community cards are dealt. While the community card area 22 is shown to be centrally located in the embodiment of FIGS. 1-9, the location of the community cards is not important and the community cards could be dealt directly into each hand.

The method continues with the steps of receiving a selection of hands to be played (such as by activation of the icon in the ante area or by some other action) and receiving an ante bet for each hand to be played. The method continues with dealing two cards for each played hand as shown in FIGS. 3, 5 and 8. The method continues with the step of receiving a selection of a fold, call or raise action for each of the played hands and then dealing one or more community cards in the community card area. The method continues with a step of ranking each hand for which a call or raise action was taken, each hand comprising the two dealt cards plus the community cards. The method continues with a step of paying out each hand in accordance with the total wager, a predetermined paytable, and the ranking of each hand.

In an embodiment where the player is provided with an optional side bet for the first two cards dealt, the payout for each hand making a side bet would additionally take into consideration the ranking of the two cards, the wager in the side bet, and the paytable for the side bet.

As noted above, another variant of the game avoids the use of dealing community cards that apply to each of the playing hands, and instead additional cards (after the initial two cards are dealt) are dealt separately to each hand. For example, in a five card stud embodiment, three additional cards are dealt into each hand. In a seven card stud embodiment, five additional cards are dealt into each hand. The cards could be dealt all at once or one at a time with a round of wagering or folding occurring after each card is dealt, as described above. In one possible variant, all of the playing hands have the same card or cards dealt to them in this phase of the game. As another variant, each playing hand could have different cards dealt in this phase of the game. The are enough cards in a standard 52 card deck of cards that seven hands could play seven card stud and have different cards dealt to each hand, or ten hands of five card stud with different cards dealt into each hand.

Casino embodiment

In a casino embodiment, the game may be played with physical playing cards at a table provided with the ante, side bet and bet areas at each playing position, analogous to the arrangement of FIG. 1. The game could be played with one player playing multiple hands, or with different players at each position, each player playing a single hand or even multiple hands. The flow of the game is basically as described above.

The game could also be played in a casino environment on a video poker or other electronic gaming device equipped with software for presenting user interface displays and controlling the game play as described in detail above. Persons skilled in this art will be able to code such software from the present description without undue effort.

Online Gaming Embodiment

As noted previously, the game of FIG. 1-10 can be played on a computer that has a connection to an electronic or virtual casino via the World Wide Web. This section of the disclosure will describe the apparatus, processing, and message flow for playing poker games in a Web-based gaming environment.

Figure 11:
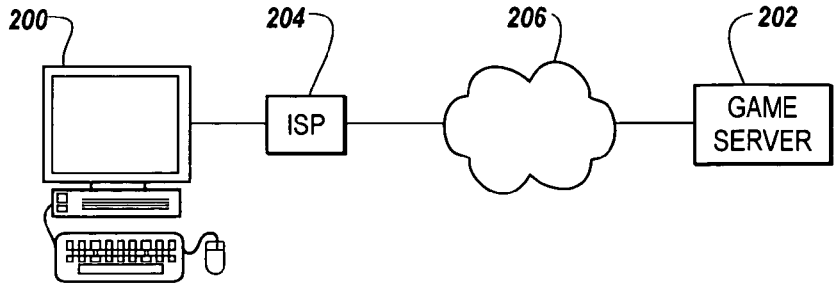
FIG. 11 is a network diagram showing a client computer which connects to a gaming server over an Internet Protocol network such as the World Wide Web in order to download gaming software and exchange messages with the gaming server and thereby play poker games as illustrated in FIGS. 1-10 over the Internet.

FIG. 11 is a network diagram showing a client computer 200 which connects to a gaming server 202 via an Internet Service Provider 204 and Internet Protocol network 206 such as the Internet. The client computer 200 downloads gaming software as described herein from the gaming server 202 and exchanges messages with the gaming server 202 as described below to play poker as illustrated in FIGS. 1-10.

At the hardware level, the client computer 200 may take the form of any general purpose computing device such as a personal computer running a Windows 2000, Windows XP, Windows ME and the like operating system, or alternative such as a Linux operating system. Only one such computer 200 is shown, but in practice any number of client computers may be connected simultaneously with the gaming server 202 and play the games. The gaming server 202 takes the form of a general purpose computing platform and may operate, for example, under a Windows Server 2003 operating system or other state of the art system. The gaming server 202 may include other functions, such as an HTML web page server. In a representative embodiment, the gaming server is managed by an entity offering Internet casino gaming services via a presence on the World Wide Web.

Figure 12:
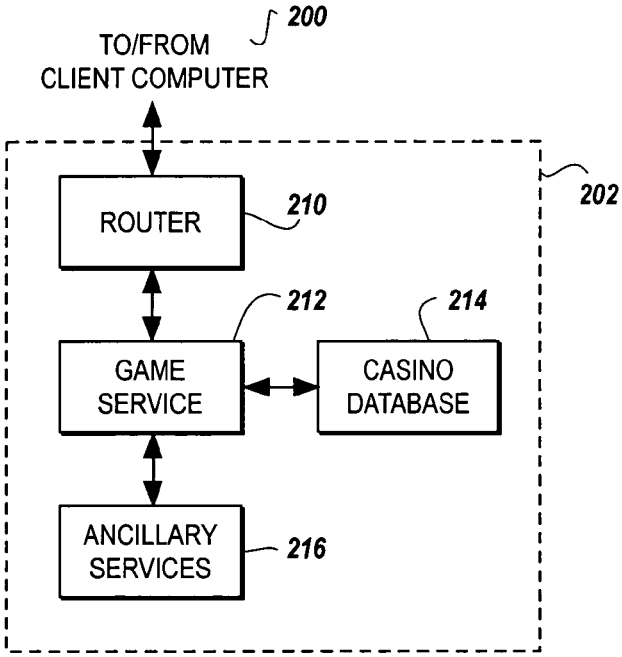
FIG. 12 is a more detailed diagram of the gaming server showing the software modules included in the gaming server in a preferred embodiment.

FIG. 12 is a more detailed diagram of the gaming server 202 showing the software modules included in the gaming server 202 in a preferred embodiment. The modules include a router module 210, a game service module 212, a casino database module 214, and an ancillary services module 216.

The router 210 provides one point of contact for all download clients 200 communicating with the gaming server 202. A download client 200 establishes a connection to the router 210 when a player using the download client 200 wishes to play a game. The router 210 receives a message from the download client and passes the message to the game service 212 for processing.

In the illustrated embodiment, the game service module 212 is written as one or more Windows Server 2003 services. The game service 212 generates an outcome for the game, determines the results of any wagers and transmits the outcome and the result of the wager back to the download client. The processing logic executed by the game service module 212 is explained in more detail in the flow chart of FIG. 10.

The casino database 214 is used to log the state of a player's session with the casino. The game service 212 on the gaming server 202 writes the outcome of the game and the result of the wager to the casino database 214, before the outcome and the result of the wager are transmitted back to the download client 200. The casino database 214 uses a state engine such that if the download client 200 disconnects from the gaming server 202 for whatever reason (say, communication failure or session termination by the player), the player will, upon subsequent reconnection with the gaming server 202, be presented with an identical screen display and game state as when disconnection occurred.

The server 202 also includes an ancillary services module 216 that performs ancillary functions related to operation of the gaming site, such as banking, player login, player registration, and the like.

The client computer 200 executes client software that is either downloaded from a remote download server and subsequently installed on the client computer, or is installed directly from a storage medium such as a compact disc. In the illustrated embodiment, the software is downloaded directly from the gaming server 202.

Figure 13:
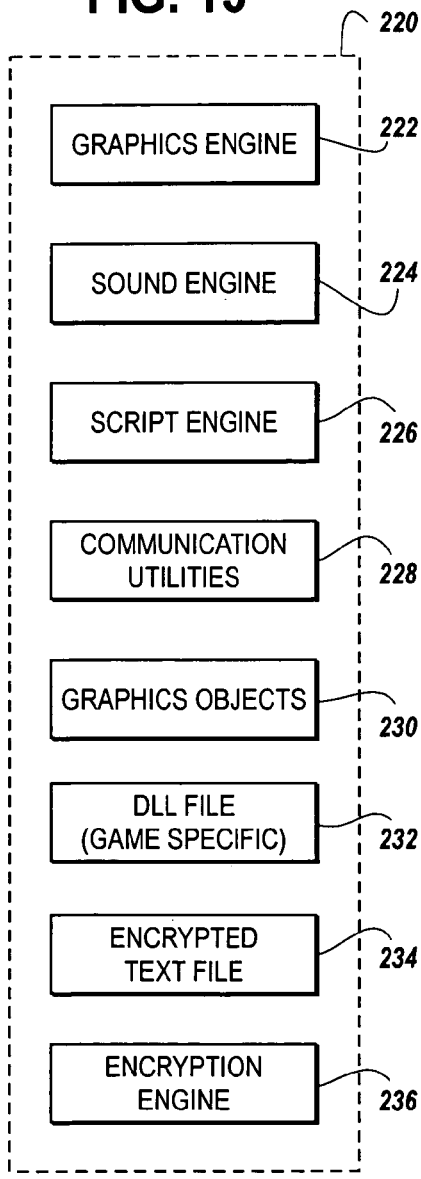
FIG. 13 is a more detailed diagram of a set of software modules which are downloaded onto the client computer in order to communicate with the gaming server and play the poker game as illustrated in FIGS. 1-10.

FIG. 13 is a more detailed diagram of a set of software modules 220 which are downloaded onto the client computer 200 and stored locally in memory in the computer 200 in order to communicate with the gaming server 202 and play the poker games with a pool hand as illustrated in FIGS. 1-10. These modules include a graphics engine 222 which renders graphics on the screen of the client computer 200, a sound engine 224 which plays sound effects occurring during play, a script engine 226 which renders text on the screen, communications utilities 228 which enable the client computer 200 to communicate with the gaming server 202, a set of graphics objects 230 such as, for example, the cards of a deck of cards, buttons and text objects, a game-specific Dynamic Link Library (DLL) file 232 that contains all the logic required for the game, and which controls the presentation of the game to the player, an encrypted text file 234 that tells the game where to position the graphics, the buttons, what graphics to load, etc., and an encryption engine 236 that provides 128-bit encryption of data communication between the download client 200 and the gaming server 202.

In the embodiment of FIGS. 11-13, the client application downloaded from the game server 202 includes instructions for presentation of the display of FIG. 1 and allows for bi-directional communication between the application and the game server to carry out the methods of FIGS. 1-10. The dealing of cards, ranking of hands, and logging of winnings and losings will typically be performed by the game server and transmissions of packets of data over the network 206 to the client application. The client application will receive such packets and present information (such as dealt cards) on the display and receive player input such as wagers, selection of hands to play, side bets, etc. and communicate such actions to the game server. Settlement of accounts will be in accordance with methods known in the art of online gaming.

As still another embodiment, the game could be played on any computing device equipped with a suitable microprocessor and memory loaded with game software. For example, the game software could be loaded on computer at home and played for amusement only (without payout of money).

While a number of exemplary aspects and embodiments have been discussed above, those of skill in the art will recognize certain modifications, permutations, additions and sub-combinations thereof are within the scope of this disclosure. It is therefore intended that the following appended claims and claims hereafter introduced are interpreted to include all such modifications, permutations, additions and sub-combinations as are within their true spirit and scope.

What is claimed is:

1. A method of playing a single player, multi-hand poker game comprising the steps of:

placing an ante bet for each of a plurality of hands to be played in a round of play of the game, wherein the plurality of played hands are played at the same time only by a single player;

optionally placing a side bet for each of the played hands, the side bet comprising a wager that a first set of cards to be dealt to each played hand will constitute cards having a predetermined ranking;

dealing the first set of cards to each played hand;

for each hand in which the side bet is played, ranking the first set of cards;

for each played hand, taking one of the following actions: a fold action, a call action or a raise action;

dealing one or more community cards;

ranking each of the played hands, each played hand formed of the first set of cards dealt plus the community cards; and paying out each of the played hands according to the ranking, any side bets placed, and a predetermined paytable.

2. The method of claim 1, wherein the method further comprises providing a gaming area for play of multiple hands and wherein the gaming area provides a play area for between two and ten hands, and wherein the player may elect to play between two and ten hands at the same time.

3. The method of claim 1, wherein the first set of cards comprises two cards, and wherein the side bet comprises a wager that the dealt two cards comprise two cards of the same suit.

4. The method of claim 1, wherein the method is played in an electronic gaming format.

5. The method of claim 4, wherein the method is played using a computer connected to a game server over the Internet.

6. The method of claim 4, wherein the method is played using physical cards.

7. The method of claim 1, wherein the community cards comprise three cards.

8. The method of claim 1, wherein the community cards comprise five cards.

9. The method of claim 1, wherein the first set of cards comprise two cards and wherein three community cards are dealt and wherein the predetermined paytable pays out according to the following schedule:

| | |
|---|---|
| Royal Flush | 500:1 |
| Straight Flush | 100:1 |
| Four of a kind | 50:1 |
| Full House | 20:1 |
| Flush | 12:1 |
| Straight | 8:1 |
| 3 of a kind: | 3:1 |
| 2 pairs: | 2:1 |
| one pair (of a predetermine rank or better) | 1:1. |

10. The method of claim 1, wherein the call bet is equal to the ante and wherein the raise bet is equal to double the ante bet.

11. The method of claim 1, wherein the method further comprises providing a table having a play area and wherein the play area comprises a wagering area for each hand to be played, the wagering area further comprising a first location for placing an ante bet, a second area for placing a raise or call bet, and a third area for placing a side bet; the table further comprising a community card area where the community cards are dealt.

12. The method of claim 1, further comprising the steps of receiving an additional wager after the step of dealing one or more community cards, and then dealing another one or more community cards.

13. A method of playing a single player, multi-hand poker game, comprising the steps of:

(a) providing a display of a play area for a plurality of hands and wherein the play area comprises a wagering area for each of a plurality of hands to be played at the same time only by a single player, the wagering area further comprising a first location for placing an ante bet, a second area for placing a raise or call bet, and a third area for placing a side bet; the play area further comprising a community card area where community cards are dealt;

(b) receiving a selection of the number of hands to be played, the number being two or greater;

(c) receiving an ante bet for each hand to be played;

(d) dealing a first set of cards for each played hand;

(e) receiving a selection of a fold, call or raise action for each of the played hands;

(f) dealing one or more community cards in the community card area;

(g) ranking each hand for which a call or raise action was taken in step (e), each hand formed from the first set of cards plus the community cards; and (h) paying out each hand in accordance with a predetermined paytable and the ranking in step (g).

14. The method of claim 13, wherein the method further comprises the steps of:

(i) receiving a side bet in advance of the dealing of the first set of cards to each played hand, and (j) for each hand in which a side bet is placed, ranking the first set of cards and paying out each hand for which a side wager is placed in accordance with the ranking and a second side wager paytable.

15. The method of claim 13, wherein the first set of cards comprises two cards and wherein the community cards comprise three cards.

16. The method of claim 13, wherein the herein the first set of cards comprises two cards and the community cards comprise five cards.

17. The method of claim 13, wherein the method is played in an electronic gaming format.

18. The method of claim 13, wherein the method is played on a computer connected with a game server over the Internet.

19. The method of claim 13, wherein the method is played using physical cards.

20. A method of playing a single player, multi-hand poker game comprising the steps of:

placing an ante bet for each of a plurality of hands to be played at the same time only by a single player;

optionally placing a side bet for each of the one or more played hands, the side bet comprising a wager that a first set of cards to be dealt to each played hand will constitute cards having a predetermined ranking;

dealing the first set of cards to each played hand;

for each hand in which the side bet is played, ranking the first set of cards;

for each played hand, taking one of the following actions: a fold action, a call action or a raise action;

dealing one or more additional cards to each of the played hands in which a call or raise action was taken;

ranking each of the played hands, each played hand formed of the first set of cards dealt plus the one or more additional cards dealt to each hand; and paying out each of the played hands according to the ranking, any side bets placed, and a predetermined paytable.

21. The method of claim 20, wherein the method further comprises providing a gaming area for play of between two and ten hands, and wherein the player may elect to play between two and ten hands.

22. The method of claim 20, wherein the game is played in an electronic gaming format.

23. The method of claim 20, wherein the one or more additional cards dealt to each of the playing hands comprise the same cards dealt to each of the playing hands.

24. The method of claim 20, wherein the one or more additional cards dealt to each of the playing hands comprise different cards dealt to each of the playing hands.

25. A method of playing a single player, multi-hand poker game, comprising the steps of:

(a) providing a display of a play area for a plurality of hands and wherein the play area comprises a wagering area for each of a plurality of hands to be played at the same time only by the single player, the wagering area further comprising a first location for placing an ante bet, a second area for placing a raise or call bet, and a third area for placing a side bet;

(b) receiving from the player a selection of a number of hands to be played at the same time by the player;

(c) receiving an ante bet for each hand to be played;

(d) dealing a first set of cards for each played hand;

(e) receiving a selection of a fold, call or raise action for each of the played hands;

(f) dealing one or more additional cards to each of the played hands in which a call or raise selection was received;

(g) ranking each hand for which a call or raise action was taken in step (e), each hand formed from the first set of cards plus the one or more additional cards dealt; and (h) paying out each hand in accordance with a predetermined paytable and the ranking in step (g).

26. The method of claim 25, wherein the method further comprises the steps of:

(i) receiving a side bet in advance of the dealing of the first set of cards to each played hand, and (j) for each hand in which a side bet is placed, ranking the first set of cards and paying out each hand for which a side wager is placed in accordance with the ranking and a second side wager paytable.

27. The method of claim 25, wherein the game is played in an electronic gaming format.

28. The method of claim 25, wherein the one or more additional cards dealt to each of the playing hands comprise the same cards dealt to each of the playing hands.

29. The method of claim 25, wherein the one or more additional cards dealt to each of the playing hands comprise different cards dealt to each of the playing hands.

* * * * *